US006817924B1

(12) United States Patent
Lin et al.

(10) Patent No.: US 6,817,924 B1
(45) Date of Patent: Nov. 16, 2004

(54) CHEMICAL MECHANICAL POLISHING APPARATUS, PROFILE CONTROL SYSTEM AND CONDITIONING METHOD THEREOF

(75) Inventors: Ching-Yen Lin, Taipei (TW); Jen-Chieh Tung, Hsinchu (TW); Chia-Ching Hsieh, Changhua (TW); Kao-Wei Huang, Hsinchu (TW)

(73) Assignee: ProMOS Technologies Inc., Hsinchu (TW)

( * ) Notice: Subject to any disclaimer, the term of this patent is extended or adjusted under 35 U.S.C. 154(b) by 0 days.

(21) Appl. No.: 10/707,740

(22) Filed: Jan. 8, 2004

(30) Foreign Application Priority Data

Dec. 11, 2003 (TW) ..... 92134973 A

(51) Int. Cl.[7] ..... B24B 49/00; B24B 1/00

(52) U.S. Cl. ..... 451/8; 451/5; 451/6; 451/56; 451/443

(58) Field of Search ..... 451/8, 5, 6, 56, 451/443; 45/72

(56) References Cited

U.S. PATENT DOCUMENTS 6,616,513 B1 * 9/2003 Osterheld ..... 451/56
2001/0015801 A1 * 8/2001 Hirose et al. ..... 356/237.2

* cited by examiner

*Primary Examiner*—Dung Van Nguyen
(74) *Attorney, Agent, or Firm*—Jiang Chyun IP Office

(57) ABSTRACT

A profile control system for controlling a profile of a polishing pad, adapted in a chemical mechanical polishing (CMP) apparatus comprises: a polishing pad, a polishing table, a polishing head, and a conditioner, wherein the polishing pad has a transparent region. The control system includes at least one illuminant, a detector and a processor. The illuminant is in the polishing table and corresponds to the transparent region of the polishing pad. The detector is over the polishing pad to detect the light from the illuminant passing through the transparent region of the polishing pad. The processor is adapted to determine the thickness of the polishing pad according to the light detected by the detector and transmits a processing signal to the conditioner for adjusting processing recipes of the conditioner. Therefore, it is possible to obtain a polishing pad of a desired profile and the variations of the uniformity of the wafers can be reduced.

29 Claims, 5 Drawing Sheets

CHEMICAL MECHANICAL POLISHING APPARATUS, PROFILE CONTROL SYSTEM AND CONDITIONING METHOD THEREOF

CROSS REFERENCE TO RELATED APPLICATIONS

This application claims the priority benefit of Taiwan application serial No. 92134973, filed on Dec. 11, 2003.

BACKGROUND OF INVENTION

1. Field of the Invention

The present invention relates to a chemical mechanical polishing (CMP) apparatus, and more particularly to a chemical mechanical polishing (CMP) apparatus, a profile control system and a conditioning method thereof.

2. Description of the Related Art

During semiconductor manufacturing, the planarization of wafers are more and more important because it will affect the subsequent photolithographic processes. Usually, the planarization of wafers is performed by CMP because of its low selective polishing characteristic. It can be applied to the shallow trench isolation process in the front-end processing, the multi-layer interconnect process in the back-end processing, advance device manufacturing processes, planarization of micro-machines and panel displays.

Traditionally, the CMP process comprises an in-line polishing step and a pad conditioning step thereafter. The conditioning step serves conditioning the profile of the polishing pad by the conditioner over the polishing pad. Moreover, the conditioning recipe is fixed.

When the uniformity of the wafers becomes worse during the production, the polishing pad is not the first priority to be checked. However, the profile of the polishing pad substantially affects the planarization of the wafers and the tool performances. If the profile of the polishing pad is not properly maintained, the service life of the polishing pad is going to be reduced.

SUMMARY OF INVENTION

Therefore, an object of the present invention is to provide a profile control system of a polishing pad, adapted to control the profile of the polishing pad for reducing the variation of the uniformity of wafers.

Another object of the present invention is to provide a chemical mechanical polishing apparatus, adapted to reduce the variation of the uniformity of wafers for obtaining a desired profile of the polishing pad after the chemical mechanical polishing process.

The other object of the present invention is to provide a chemical mechanical polishing apparatus, adapted to polish a plurality of wafers simultaneously and to control the profiles of the polishing pads.

A further object of the present invention is to provide a method of controlling the profile of the polishing pad, adapted to adjust the processing recipe of a conditioner for controlling the profile of the polishing pad.

According to the objects above, the present invention discloses a profile control system of a polishing pad, adapted for a chemical mechanical polishing apparatus. The chemical mechanical polishing apparatus comprises a polishing pad, a polishing table, a polishing head and a conditioner, wherein the polish pad comprises a transparent region. The profile control system of a polishing pad comprises: at least one illuminant, a detector and a processor. The illuminant is configured in the polishing table, wherein the illuminant corresponds to the transparent region of the polishing pad. The detector is configured over the polishing pad for detecting the light through the transparent region of the polishing pad. According to a detection of the detector, a processor evaluates a thickness and a profile of the polishing pad and transmits a processing signal to the conditioner for adjusting a processing recipe of the conditioner to obtain a desired profile of the polishing pad.

The present invention also discloses a chemical mechanical polishing apparatus, adapted to polish a wafer. The chemical polishing apparatus comprises a polishing table, a polishing pad, a detector, a processor, a conditioner and a polishing head. The polishing table has at least one illuminant. The polishing pad covers the polishing table, wherein the polishing pad has at least one transparent region corresponding to the illuminant of the polishing table. The detector is configured over the polishing pad for detecting a light passing through the transparent region of the polishing pad. The processor is coupled to the detector, wherein the processor is adapted to evaluate a thickness and a profile of the polishing pad and transmit a processing signal according to the thickness and the profile determined by the processor. The conditioner is configured over the polishing pad and coupled to the processor, wherein the conditioner is adapted to adjust a processing recipe according to the processing signal from the processor to obtain a desired profile of the polishing pad. The polishing head is configured over the polishing pad and beside the conditioner for holding the wafer.

The present invention also discloses a chemical mechanical polishing apparatus, adapted to polish a plurality of wafers. The chemical mechanical polishing apparatus comprises a plurality of polishing tables, a plurality of polishing pads, a plurality of detectors, a processor, conditioners and a plurality of polishing heads. Each of the polishing tables has at least one illuminant. The plurality of polishing pads is positioned over the corresponding polishing tables, wherein each of the polishing pads has at least one transparent region corresponding to the each illuminant of the polishing tables. The plurality of detectors is configured over the polishing pad for detecting a light through the transparent regions of the polishing pads. The processor is coupled to the detectors, wherein the processor is adapted to evaluate the thickness and profile of the polishing pads and transmits a plurality of processing signals according to the thickness and profiles determined by the processors. The conditioners are configured over the polishing pads and coupled to the processor, wherein the conditioners are adapted to adjust processing recipes according to the processing signals from the processor to maintain desired profiles of the polishing pads. The polishing heads are configured over the polishing heads and beside the conditioners for holding the wafers.

The present invention further discloses a method of controlling polishing pad profile, adapted to adjust a processing recipe of a conditioner for controlling a profile of a polishing pad. The method comprises: using a detector for detecting a light from a polishing table under the polishing pad; using a processor coupled to the detector for determining a thickness of the polishing pad and transmitting a processing signal according to the thickness of the polishing pad determined by the processor; and adjusting the processing recipe of the conditioner according to the processing signal from the processor, for obtaining a desired profile of the polishing pad.

The chemical mechanical polishing apparatus of the present invention uses a profile control system in conjunction with the transparent region of the polishing pad and the illuminant in the polishing table for controlling the profile of the polishing pad so as to reduce the variation of the uniformity of the wafers and to obtain a desired profile of the polishing pad. Therefore, when the profile of the polishing pad is determined to be out of spec, the system conditioning process is activated for conditioning the polishing pad until a desired profile is obtained. Moreover, the present invention can be applied to an in-situ or an ex-situ process. The in-situ process continuously increases or reduces the dressing amount according to the processing data during the process. The ex-situ process increases or reduces the dressing amount according to the stored processing data.

In order to make the aforementioned and other objects, features and advantages of the present invention understandable, a preferred embodiment accompanied with figures is described in detail below.

DETAILED DESCRIPTION

The present invention discloses a chemical mechanical polishing (CMP) apparatus and a profile conditioning method of a polishing pad thereof, which can be applied to a variety of planarization processes. Following are the embodiments of the present invention. The present invention, however, is not limited thereto.

Figure 1:
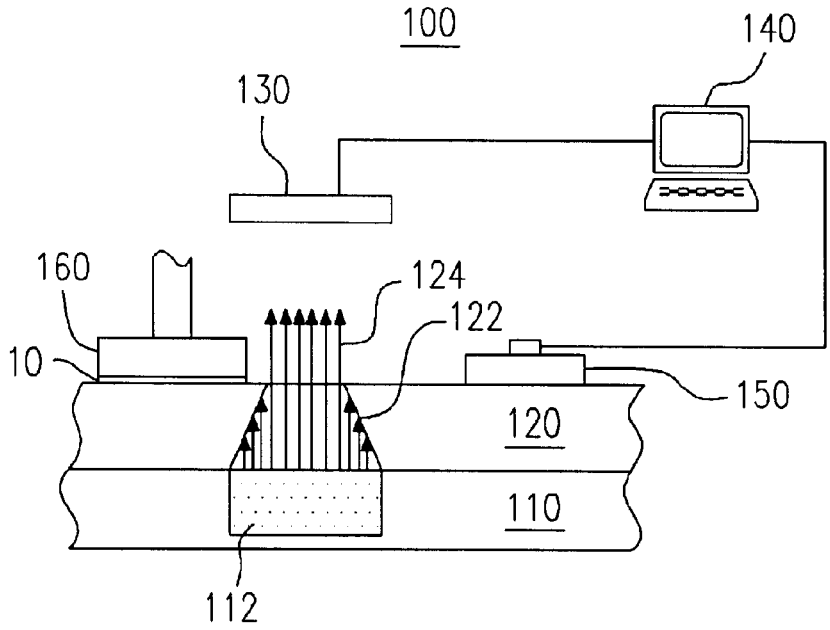
FIG. 1 is a schematic system configuration showing a CMP apparatus according to a preferred embodiment of the present invention.

FIG. 1 is a schematic view showing a CMP according to a preferred embodiment of the present invention. Referring to FIG. 1, the CMP apparatus 100 comprises a polishing table 110, a polishing pad 120, a detector 130, a processor 140, a conditioner 150 and a polishing head 160. The polishing table 110 has at least one illuminant 112. The polishing pad 120 covers the polishing table 110, wherein the polishing pad 120 has at least one transparent region 122 corresponding to the illuminant 112 of the polishing table 110. The detector 130 is configured over the polishing pad 120 for detecting a light passing through the transparent region 122 of the polishing pad 120. The processor 140 is coupled to the detector 130, wherein the processor 140 is adapted to evaluate a thickness and a profile of the polishing pad 120 and transmit a processing signal according to the thickness and the profile determined by the processor 140. The detail descriptions of evaluation of the thickness of polishing pad 120 are illustrated below. The conditioner 150 is configured over the polishing pad 120 and coupled to the processor 140, wherein the conditioner 150 is adapted to adjust a processing recipe according to the processing signal from the processor 140 to obtain a desired profile of the polishing pad 120. The polishing head 160 is configured over the polishing pad 120 and beside the conditioner, the polishing head 160 is configured for holding and polishing the wafer 10. The illuminant 112 of the polishing table 110 has different variants as shown in FIG. 2.

Figure 2:
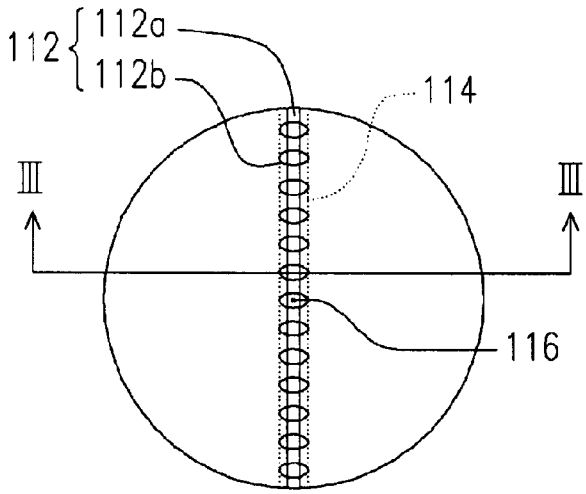
FIG. 2 is a top view of the CMP apparatus of FIG. 1.

FIG. 2 is a top view of the CMP apparatus of FIG. 1. Referring to FIG. 2, the illuminant 112 of the polishing table 110 is configured with a linear illuminant region 114 along a radial direction of the polishing table 110, wherein the illuminant comprises a strip illuminant 112*b* or a plurality of spot illuminants 112*a*. Moreover, the disposition of the illuminant 112 can be diametrical on the polishing pad 110 as shown in FIG. 2, or extend from the center 116 of the polishing pad 110 to the edge thereof.

Moreover, the illuminant can be, for example, a luminescence illuminant. The evaluation of the thickness of polishing pad 120 by detecting a light passing through the transparent region 112 is described with reference to FIG. 3 as follows.

Figure 3:
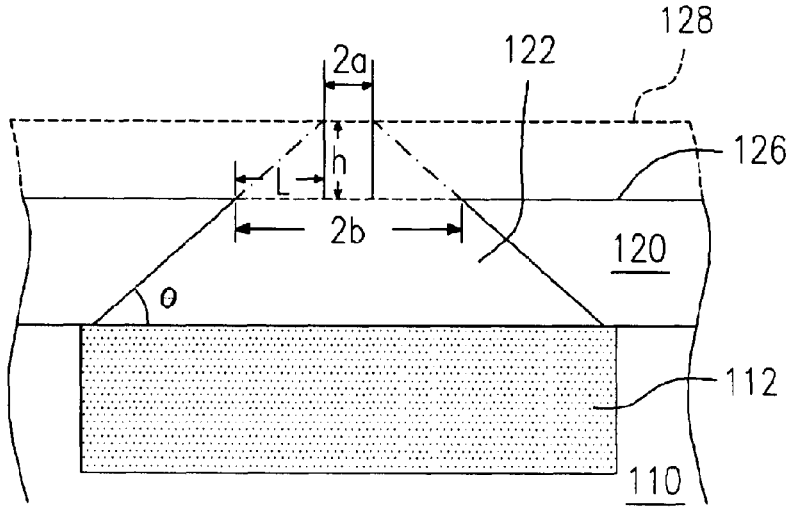
FIG. 3 is a cross-sectional view taken along III—III of FIG. 2.

FIG. 3 is a cross-sectional view taken along III—III of FIG. 2. Referring to FIG. 3, a cross-section of the transparent region 122 of the polishing pad 120 can be a trapezoid. The original width of the transparent region 122 on the top 128 of the polishing pad 120 is 2*a*. After polishing, the width of the transparent region 122 on the top 126 becomes larger represent by 2*b* as shown in FIG. 3. The width 2*b* can be detected by detecting the light passing through the transparent region 122 by the detector 130. When the angle θ between the side surface of the transparent region 122 and the polishing table is known, the removed top portion of the polishing pad 120 or the differential height, h, of the polishing pad 120 before and after the polishing process can be obtained from the following formula: $h=L\times\tan\theta=(b-a)\times\tan\theta$–formula 1.

Therefore, the processor 140 can determine the thickness of the polishing pad 120 relative to the original thickness thereof. The description above is an exemplary method of evaluating the thickness of the polishing pad 120 by determining the area of the transparent region 122 of the polishing pad 120. However the present invention is not limited thereto.

Figure 4:
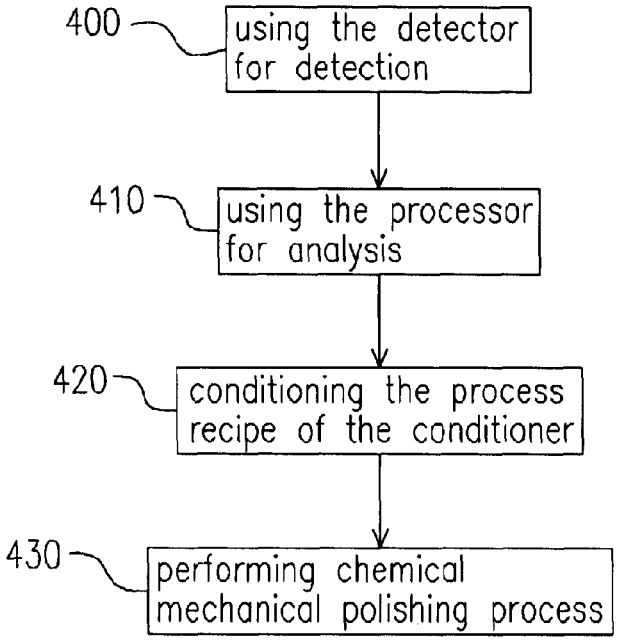
FIG. 4 is an operation flowchart showing a method of controlling a profile of a polishing pad using the CMP apparatus shown in FIG. 1.

FIG. 4 is an operation flowchart showing a method of controlling the profile of the polishing pad using the CMP apparatus shown in FIG. 1.

Referring to FIG. 4, the present invention discloses a method of controlling the profile of the polishing pad. In step 400, a detector is used for detecting a light 124 passing through the transparent region 122 of the polishing table 110 under the polishing pad 120. Next, in step 410, a processor, which is coupled to the detector, is used for determining a thickness of the polishing pad and transmits a processing signal according to the thickness determined by the processor. Next, in step 420, the processing recipe of the conditioner is adjusted according to the processing signal from the processor, for obtaining a desired profile condition thereof, wherein the processing signal comprises in-situ feedback data or stored feedback data. After adjusting the processing recipe, the method further comprises a process of conditioning the polishing pad by using the conditioner for increasing or reducing a dressing amount. Then, a polishing process 430 is performed. The present invention can be applied to an in-situ or an ex-situ chemical mechanical polishing process. Following are two exemplary CMP apparatuses.

Figure 5:
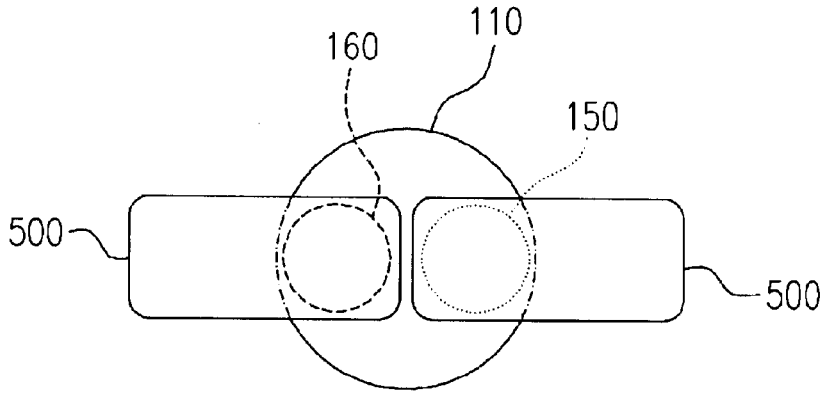
FIG. 5 is a top view showing a second exemplary CMP apparatus of the present invention.

FIG. 5 is a top view showing a second exemplary CMP apparatus of the present invention. In order to be distinguished from the first embodiment, some elements with the function similar to that of FIG. 1 are applied therein.

Compared with the first embodiment, the second embodiment performs polishing and pad conditioning simultaneously. A robot 500 holds and puts the polishing head 160 and the conditioner 150 on the polishing table 110. Therefore, the polishing pad 160 and the conditioner 150 can be processed simultaneously. Moreover, the detector (not show) can be configured on the robot 500 for detecting a light passing through the transparent region 122 of the polishing table 110 shown in FIG. 1.

Figure 6:
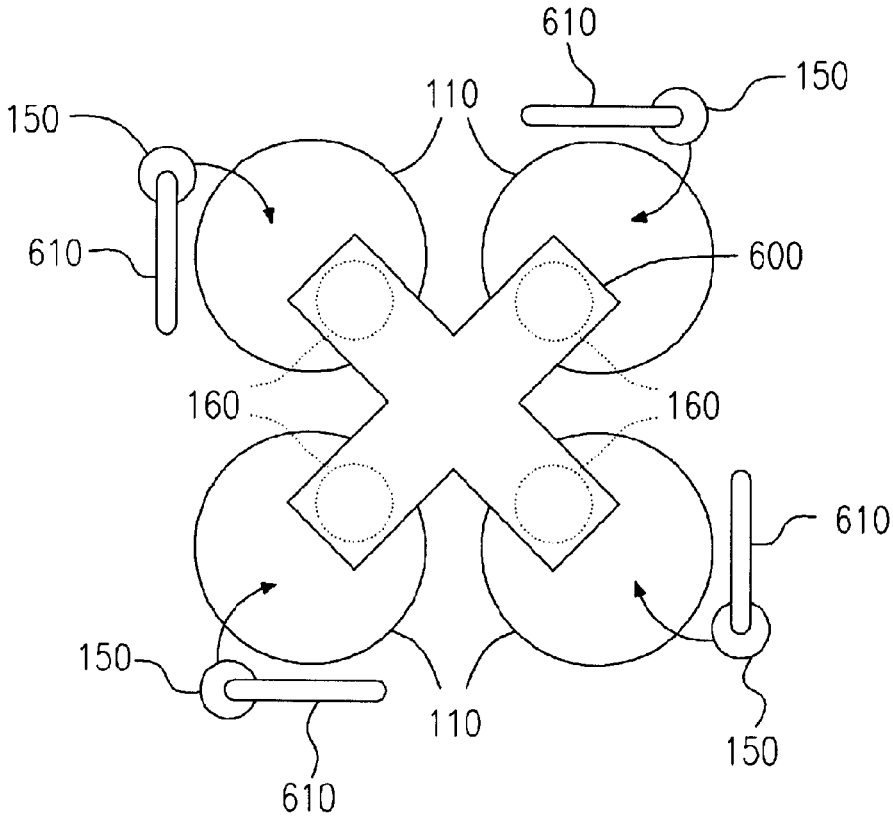
FIG. 6 is a top view showing a third exemplary CMP apparatus of the present invention.

FIG. 6 is a top view showing a third exemplary CMP apparatus of the present invention. In order to be distinguished from the first embodiment, some elements with the function similar to that of FIG. 1 are applied therein.

Compared with the first embodiment, the third embodiment can polish a plurality of wafers simultaneously. The apparatus has pluralities of polishing tables 110, polishing head 160 and conditioner 150. Each polishing head 160 is moved by a robot 600. Each conditioner 150 can be controlled by a robot 610. The moving track of the polishing head 160 is along the arrow shown in FIG. 6. Moreover, the detector (not show) can be configured on the robot 600 for detecting a light passing through the transparent region 122 of the polishing table 110 shown in FIG. 1.

To prove the efficacy of the present invention, following are the experimental results thereof.

Figure 7:
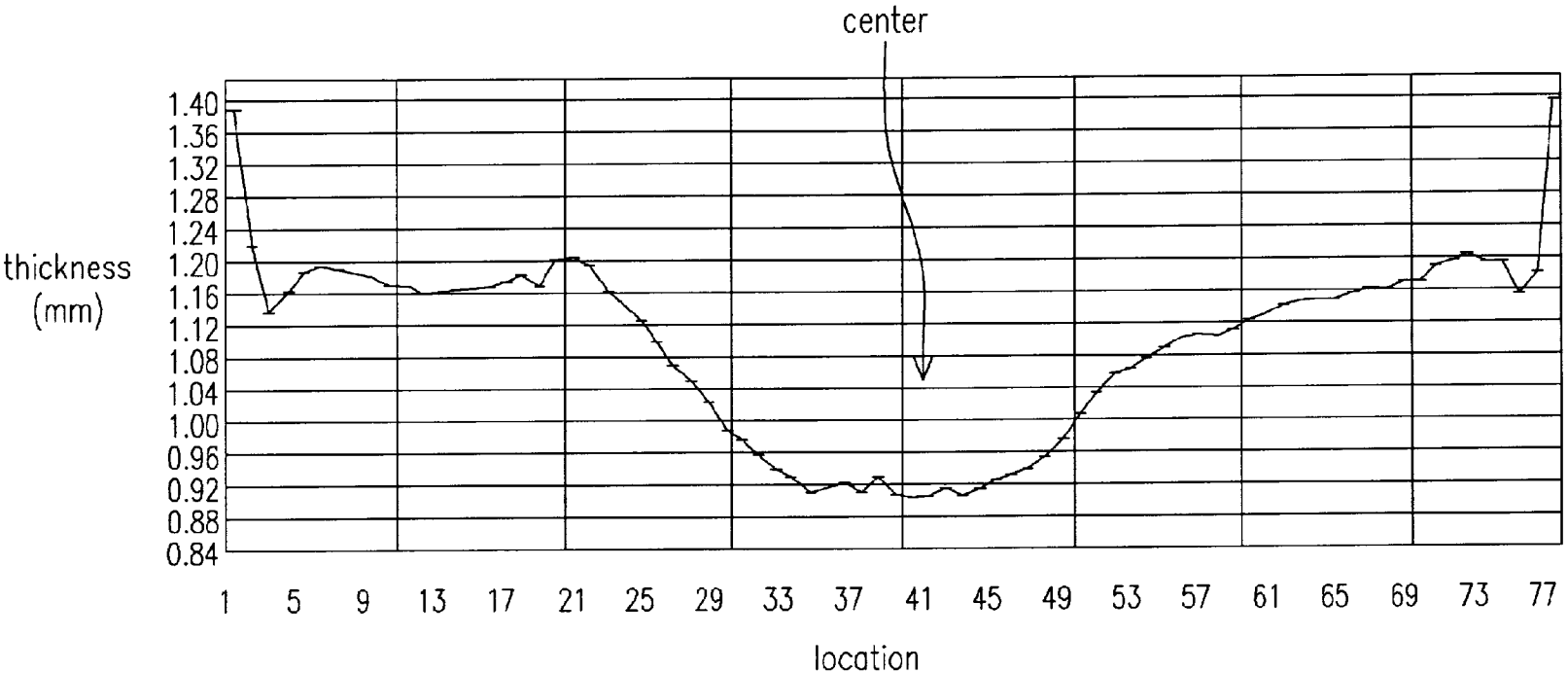
FIG. 7 is a profile curve of the polishing pad of a prior art CMP apparatus without being equipped with the profile control system.
Figure 8:
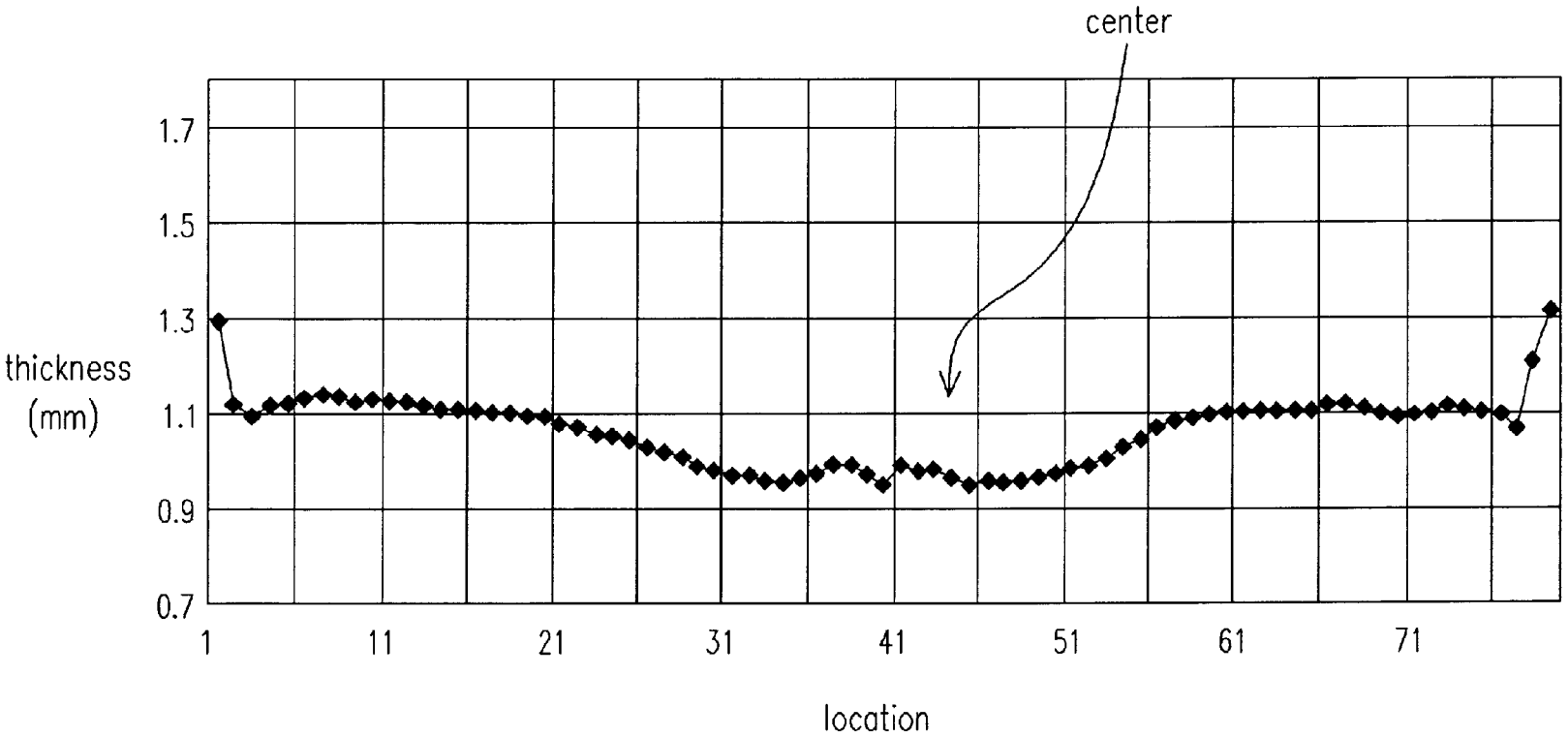
FIG. 8 is a profile curve of the polishing pad of a CMP apparatus equipped with the profile controlling system of the present invention.

FIG. 7 is a profile curve of the polishing pad of a prior art CMP apparatus without being equipped with the profile control system. FIG. 8 is a profile curve of the polishing pad of a CMP apparatus equipped with the profile controlling system of the present invention. Referring to FIGS. 7 and 8, the profile of the polishing pad shown in FIG. 8 is more planar than that in FIG. 7. Obviously, the differential thickness between the central region of the polishing pad and the peripheral region thereof is less using the CMP apparatus equipped with the profile control system of the present invention compared to that using the CMP apparatus not equipped the profile control system. From an observation of the results above, one can infer that prior art CMP apparatus being not equipped with the profile control system could easily cause non-uniformity (WIWNU) in the topography of the wafer.

Accordingly, the feature of the present invention is the use a profile control system for detecting a light emitted by the illuminant disposed in the polishing table passing through the transparent region and thereby control the profile of the polishing pad. Accordingly a desired profile of the polishing pad of the polishing pad after the polishing process can be obtained. Therefore, the variation of the uniformity in topography of the wafers can be reduced. Therefore, when the profile of the polishing pad is out of spec, the profile control system can be adapted for adjusting the profile of the polishing pad until a desired profile is obtained. Moreover, the present invention can continuously increase or reduce the dressing amount according to the processing data during the process, or according to the stored processing data.

Although the present invention has been described in terms of exemplary embodiments, it is not limited thereto. Rather, the appended claims should be constructed broadly to include other variants and embodiments of the invention which may be made by those skilled in the field of this art without departing from the scope and range of equivalents of the invention.

What is claimed is:

1. A profile control system, for controlling a profile of a polishing pad, adapted in a chemical mechanical polishing apparatus, the chemical mechanical polishing apparatus comprising a polishing pad having a transparent region, a polishing table, a polishing head and a conditioner, the profile control system comprising:

at least one illuminant, configured in the polishing table, wherein the illuminant is positioned in the polishing table corresponding to the transparent region of the polishing pad;

a detector, configured over the polishing pad for detecting a light passing through the transparent region of the polishing pad; and a processor, adapted to evaluate a thickness and a profile of the polishing pad and transmits a processing signal to the conditioner according to the thickness and the profile determined by the processor for adjusting a processing recipe of the conditioner to reduce a differential thickness between a central portion of the polishing pad and a peripheral portion thereof.

2. The profile control system for controlling a profile of a polishing pad of claim 1, wherein the illuminant is configured with a linear illuminant region along a radial direction of the polishing table.

3. The profile control system for controlling a profile of a polishing pad of claim 2, wherein the illuminant comprises a strip illuminant or a plurality of spot illuminants.

4. The profile control system for controlling a profile of a polishing pad of claim 1, wherein the processor determines a thickness of the polishing pad by detecting an area of the transparent region via the detector for determining a local polishing condition thereof.

5. The profile control system for controlling a profile of a polishing pad of claim 1, wherein the illuminant comprises a luminescence illuminant.

6. The profile control system for controlling a profile of a polishing pad of claim 1, wherein the detector is disposed on a robot, which is adapted to move the polishing head.

7. A chemical mechanical polishing apparatus, adapted for polishing a wafer, comprising:

a polishing table, having at least one illuminant;

a polishing pad, covering the polishing table, wherein the polishing pad has at least one transparent region corresponding to the illuminant of the polishing table;

a detector, configured over the polishing pad for detecting a light passing through the transparent region of the polishing pad;

a processor, coupled to the detector, adapted to evaluate a thickness and a profile of the polishing pad and transmit a processing signal according to the thickness and the profile determined by the processor;

a conditioner, configured over the polishing pad and coupled to the processor, wherein the conditioner is adapted to adjust a processing recipe according to the processing signal from the processor to reduce a differential thickness between a central portion of the polishing pad and a peripheral portion thereof; and a polishing head, configured over the polishing pad and beside the conditioner for holding the wafer.

8. The chemical mechanical polishing apparatus of claim 7, wherein the illuminant is configured in a linear illuminant region along a radial direction of the polishing table.

9. The chemical mechanical polishing apparatus of claim 8, wherein the illuminant comprises a strip illuminant or a plurality of spot illuminants.

10. The chemical mechanical polishing apparatus of claim 7, wherein the processor determines the thickness of the polishing pad by detecting an area of the transparent region via the detector for determining a local polishing condition thereof.

11. The chemical mechanical polishing apparatus of claim 7, wherein the illuminant comprises a luminescence illuminant.

12. The chemical mechanical polishing apparatus of claim 7, further comprising a robot over the polishing pad and connected to the polishing head for moving the polishing head.

13. The chemical mechanical polishing apparatus of claim 12, wherein the detector is disposed on the robot.

14. The chemical mechanical polishing apparatus of claim 7, further comprises a robot over the polishing pad and connected to the conditioner for moving the conditioner.

15. A chemical mechanical polishing apparatus, adapted for polishing a plurality of wafers, comprising:

a plurality of polishing tables, each having at least one illuminant;

a plurality of polishing pads covering the polishing tables, wherein each of the polishing pads has at least one transparent region corresponding to the each illuminant of the polishing tables;

a plurality of detectors, configured over the polishing pad for detecting a light passing through the transparent regions of the polishing pads;

a processor, coupled to the detectors, adapted to evaluate thickness and profiles of the polishing pads and transmit a plurality of processing signals according to the thickness and the profiles determined by the processor;

a plurality of conditioners, configured over the polishing pads and coupled to the processor, wherein the conditioners are adapted to adjust processing recipes according to the processing signals from the processor to reduce a differential thickness between a central portion of the polishing pads and a peripheral portion thereof; and a plurality of polishing heads, configured over the polishing pads and beside the conditioners for holding the wafers.

16. The chemical mechanical polishing apparatus of claim 15, wherein each the illuminants are configured in each linear illuminant region along a radial direction of the polishing tables.

17. The chemical mechanical polishing apparatus of claim 16, wherein the each illuminant comprises a strip illuminant or a plurality of spot illuminants.

18. The chemical mechanical polishing apparatus of claim 15, wherein the processor determines the thickness of the polishing pads by detecting areas of the transparent regions via the detectors for determining local polishing conditions thereof.

19. The chemical mechanical polishing apparatus of claim 15, wherein the each illuminant comprises a luminescence illuminant.

20. The chemical mechanical polishing apparatus of claim 15, further comprising a robot over the polishing pads and connected to the polishing heads for moving the polishing heads.

21. The chemical mechanical polishing apparatus of claim 20, wherein the detectors is disposed on the robot.

22. The chemical mechanical polishing apparatus of claim 15, further comprises a plurality of robots over the polishing pad and connected to the conditioners for moving the conditioners.

23. A method of controlling a profile of a polishing pad, adapted in a chemical mechanical polishing apparatus, the method comprising:

using a detector for detecting a light from a polishing table passing through the polishing pad;

using a processor for determining a thickness of the polishing pad and transmitting a processing signal according to the thickness determined by the processor; and adjusting the processing recipe of the conditioner according to the processing signal from the processor for reducing a differential thickness between a central portion of the polishing pad and a peripheral portion thereof.

24. The method of controlling a profile of a polishing pad of claim 23, further comprising a step of adjusting the polishing pad using the conditioner for increasing a dressing amount after adjusting the processing recipe of the conditioner.

25. The method of controlling a profile of a polishing pad of claim 23, further comprising a step of adjusting the polishing pad using the conditioner for reducing a dressing amount after adjusting the processing recipe of the conditioner.

26. The method of controlling a profile of a polishing pad of claim 23, wherein the step of determining the thickness of the polishing pad is performed by detecting a light from the polishing table through a transparent region of the polishing pad to determine a local polishing condition of the polishing pad.

27. The method of controlling a profile of a polishing pad of claim 26, wherein the step of determining the thickness of the polishing pad is performed by detecting a light from the polishing table through an area of the transparent region of the polishing pad.

28. The method of controlling a profile of a polishing pad of claim 23, wherein the method is applied to an in-situ chemical mechanical polishing process.

29. The method of controlling polishing pad profile of claim 23, wherein the method is applied to an ex-situ chemical mechanical polishing process.

* * * * *